US006443665B1

(12) United States Patent
Kundel, Sr.

(10) Patent No.: US 6,443,665 B1
(45) Date of Patent: Sep. 3, 2002

(54) TRENCH SHIELDING AND SHORING DEVICE

(76) Inventor: Robert Kundel, Sr., 2186 Howland Wilson Rd., Cortland, OH (US) 44410

( * ) Notice: Subject to any disclaimer, the term of this patent is extended or adjusted under 35 U.S.C. 154(b) by 68 days.

(21) Appl. No.: 09/778,520

(22) Filed: Feb. 7, 2001

(51) Int. Cl.[7] ..... E02D 17/08

(52) U.S. Cl. ..... 405/283; 405/282; 405/274; 405/272

(58) Field of Search ..... 405/282, 283, 405/284, 285, 272, 273, 274, 275, 276

(56) References Cited

U.S. PATENT DOCUMENTS

| | | | | |
|---|---|---|---|---|
| 841,773 | A | 1/1907 | Fitzgerald | |
| 2,188,077 | A | 1/1940 | Dowd | |
| 2,246,632 | A | 6/1941 | Dorey | |
| 2,260,423 | A | 10/1941 | Washbourne | |
| 3,393,521 | A | 7/1968 | Cammisa | |
| 4,054,033 | A | 10/1977 | Pillosio | |
| 4,058,983 | A * | 11/1977 | Griswold | 405/282 |
| 4,114,383 | A | 9/1978 | Nieber | |
| 4,199,278 | A * | 4/1980 | Koehl | 405/282 |
| 4,345,857 | A * | 8/1982 | Krings | 405/282 |
| 4,752,157 | A * | 6/1988 | Ischebeck et al. | 405/282 |
| 4,993,880 | A | 2/1991 | Collins | |
| 5,073,066 | A * | 12/1991 | Richland | 405/282 |
| 5,158,398 | A * | 10/1992 | Pinho | 405/282 |
| 5,232,312 | A | 8/1993 | Jennings et al. | |
| 5,399,057 | A * | 3/1995 | Cunic | 405/282 |
| 5,503,504 | A | 4/1996 | Hess et al. | |
| 5,876,153 | A | 3/1999 | Krings | |
| 5,885,033 | A | 3/1999 | Krings | |

* cited by examiner

*Primary Examiner*—Heather Shackelford
*Assistant Examiner*—Frederick L. Lagman
(74) *Attorney, Agent, or Firm*—Robert J. Herberger

(57) ABSTRACT

A portable shoring device for securing the sidewalls of an excavation having a pair of walls or panels mutually facing each other and being held in spaced apart relationship by at least one support bar. Attached at opposite ends of each panel are vertical supports, which are arranged to pair in a substantially perpendicular coupling relationship with the corresponding vertical supports of the opposite panel. Each vertical support traverses along the height of the panel and has a female connection bracket. A plurality of panel connectors having a male connection device are slideably connectable with each panel by interlocking the corresponding female connection bracket of the corresponding vertical support with the male connection extension of the panel connector. The support bar attaches between two panel connectors on paired panels. Further, each panel connector has a bottom stop plate and a top panel lock to vertically secure the connected panel.

18 Claims, 6 Drawing Sheets

TRENCH SHIELDING AND SHORING DEVICE

FIELD OF THE INVENTION

This invention relates to a portable shielding and shoring device for securing the sidewalls of an excavation. More specifically, the instant invention relates to a trench shielding and shoring system having panel ends slideably connectable with panel connectors, thereby reducing the need for pins, bolts, clamps or other connection methods during assembly.

BACKGROUND

Trench excavation is recognized by the Occupational Safety and Health Administration ("OSHA") as being an extremely hazardous construction operation. Due to unstable soil conditions, improper sloping of an excavation and/or other unaccounted for occurrences, landslides and cave-ins ensue. These natural occurrences have been known to destroy equipment, postpone job completion and, most seriously, injure or kill the workers inside the excavation. Therefore, "shielding" and/or "shoring" of trench faces is required by OSHA. Trench "shielding" is known by those skilled in the art to protect workers from cave-ins and/or landslides, but allows for normal shifts and fissures of the trench face. Trench "shoring," on the other hand, is used to prevent any movement of the trench face when excavating near foundations, roadways or existing underground utilities, so as not to damage the same. Contractors who do not comply with OSHA's regulations on trench safety procedures are taking a grave risk.

Known shielding and shoring devices are constructed with panels having a vertical face made of either wood or metal using various heights and widths and being held in spaced apart relationship with support bars, commonly referred to in the industry as spreaders or struts. Typically, shielding and/or shoring devices are assembled above ground at the job site by workers. These devices are laboriously assembled by first fastening each panel end to individual panel connectors through the use of a plurality of pins or clamps. Lateral support bars are then connected between each pair of oppositely disposed panel connectors to complete the device. Once assembled, the shielding and/or shoring device is placed in the excavated trench.

Examples of shoring or shielding devices include U.S. Pat. No. 4,114,383 to Nieber, which describes a portal frame for a trench box structure, showing vertical structural columns in the form of H-shaped beams being connected to panels and then bolted. Another shoring device is disclosed in U.S. Pat. No. 5,232,312 to Jennings et al., showing horizontal whalers being connected directly to the shielding panels by multiple fasteners. Finally, a trench box device described in U.S. Pat. No. 4,993,880 to Collins shows upper and lower strut connecters being bolted or welded to end-posts for connecting the panels to the struts. The end posts are permanently attached by weld to the face of the panel.

The problem with the aforementioned shoring and/or shielding devices is that multiple fasteners must be used during assembly. This means that it takes a substantial amount of time to attach the panel ends and panel connectors together using pins or clamps. Furthermore, because of their small size, fasteners are often lost or misplaced in a busy construction environment. Assembling a typical shoring and/or shielding device is therefore overly time consuming and burdensome for an already busy contractor. In fact, some deaths resulting from cave-in accidents would have been prevented if a contractor had taken the necessary time to assemble a trench box properly. In an effort to save time and meet completion deadlines, some contractors may even try to cut comers by neglecting to assemble and place a shielding device in the trench, having workers do their job in a trench that is not properly secured.

For the foregoing reasons, there is a need for a shoring and/or shielding device which is quick and easy to assemble, use, disassemble and store, without sacrificing strength and reliability.

SUMMARY OF THE INVENTION

The present invention is directed to a portable shielding and shoring device for securing the sidewalls of an earthen excavation. More specifically, this invention satisfies the need for a shielding and shoring device that is safe and durable, as well as easy to assemble, use and disassemble. For purposes of this description, we will refer to the instant invention as a shoring device, although it is applicable for both shielding and shoring purposes.

The instant invention comprises a pair of walls comprising at least one panel mutually facing each other and held in spaced apart relationship by at least one support bar on each side. An embodiment of the invention may comprise at least three planks to make a panel. Attached at opposite ends of each panel are permanently attached vertical supports, which are arranged to pair in a substantially perpendicular coupling relationship with the corresponding vertical supports of the opposite panel. Each vertical support traverses along the height of the panel and has a first engaging link. Panel connectors having a second engaging link are slideably correctable with each panel end by simply interlocking the corresponding first engaging link of the corresponding vertical support with the second engaging link of the panel connector. The second engaging link may be a male connecting extension designed to have a substantially rounded cross-section with a lateral extension attached to the inside channel of a connector body, a substantially T-shaped cross-section or a substantially mushroom-shaped cross-section. Accordingly, the first engaging link may be a female connection bracket. The support bar attaches between two panel connectors on paired panels by support bar adaptors which are substantially aligned. Further, each panel connector has a bottom stop plate and a top panel lock to vertically secure the connected panel thereto.

There are several advantages of the instant invention over the prior devices. For example, because of the sliding connection between the panel connectors and the vertical support members of the panels, the shoring device is easy for contractors to assemble, use and disassemble without sacrificing strength and reliability, and the height of the wall may be easily changed by slideably connecting and stacking additional panels, or removing the same, in corresponding panel connectors.

Accordingly, it is an objective of the present invention to provide a device that is fast to assemble, disassemble and store in a busy construction environment.

It is yet another of the present invention to provide a device that does not require the use of several fasteners, such as pins or clamps, to connect panel connectors with vertical supports.

Still another object of the present invention is to provide a device that meets OSHA safety requirements for trench excavation work.

Further, another object of the present invention is to provide a device that requires fewer small parts, which facilitates easy assembly at the construction site.

Many other objects and features of the present invention will be obvious to those having skill in the art upon contemplation of the disclosure herein in connection with the accompanying drawings.

BRIEF DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the detailed description made with reference to the following drawings:

DETAILED DESCRIPTION OF THE PREFERRED EMBODIMENT

Figure 1:
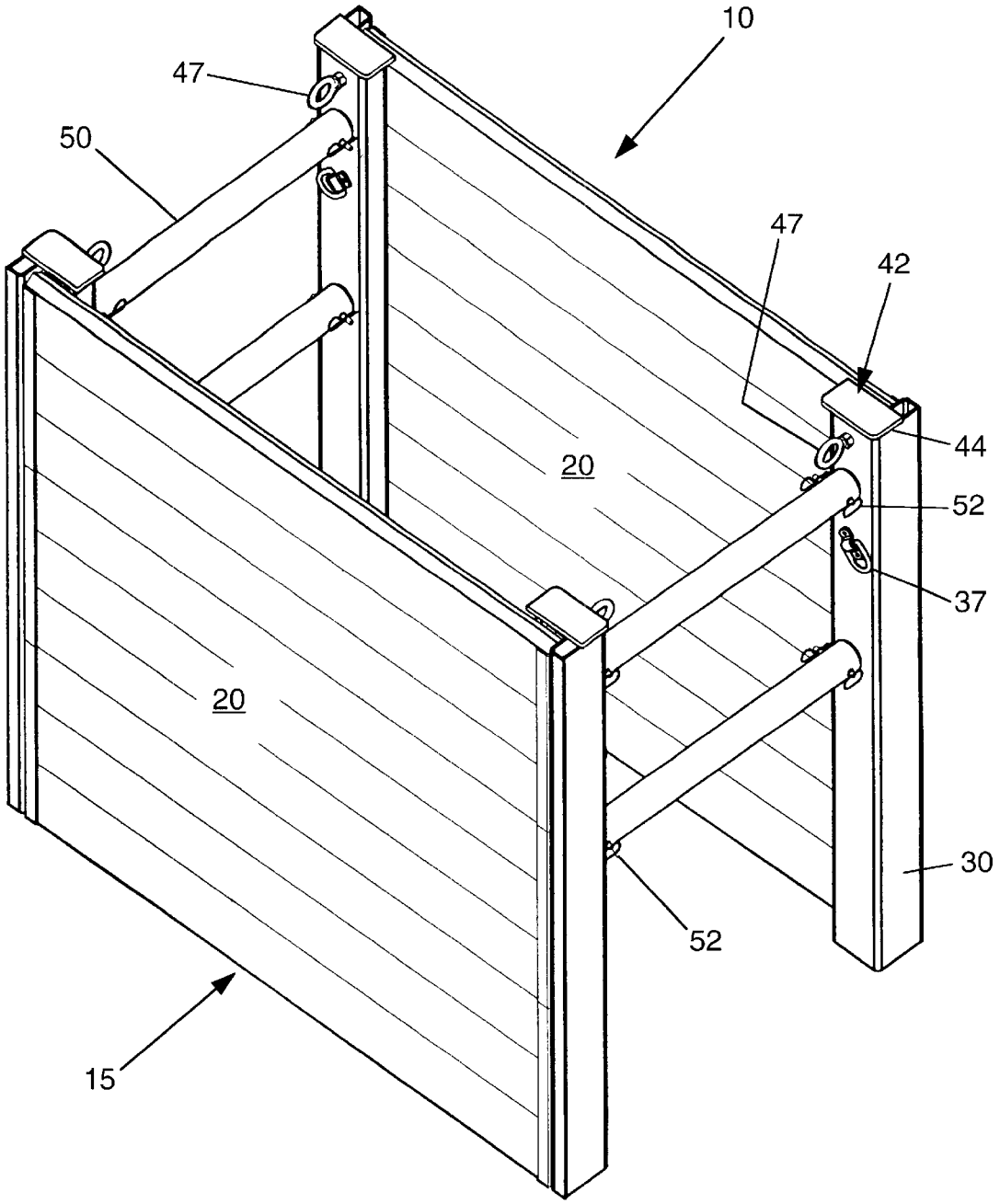
FIG. 1 is a perspective view of the trench shielding and shoring device of the present invention.
Figure 2:
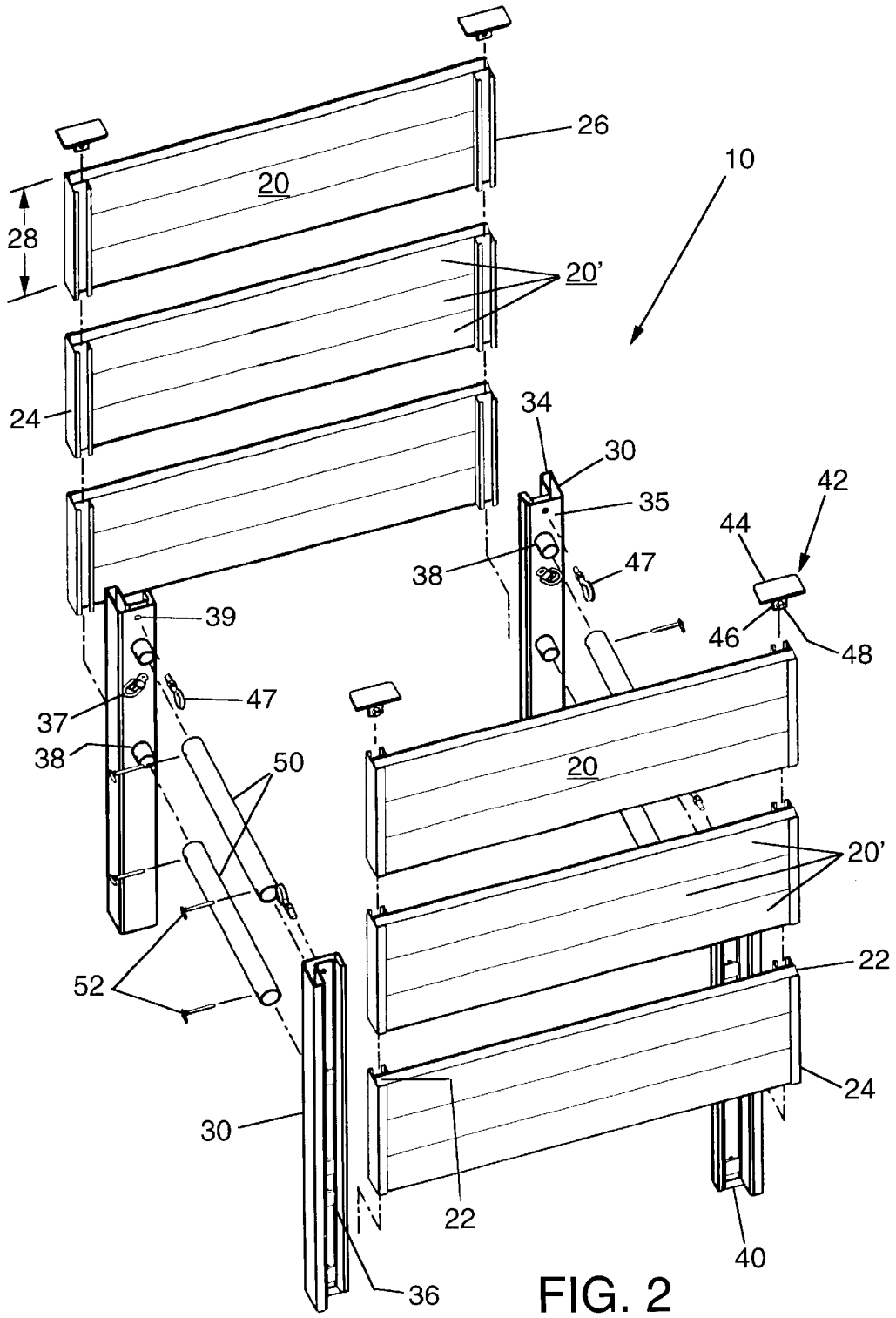
FIG. 2 is a somewhat schematic perspective view of the invention in illustration of the ease of assembly, handling and disassembly for transportation.
Figure 3:
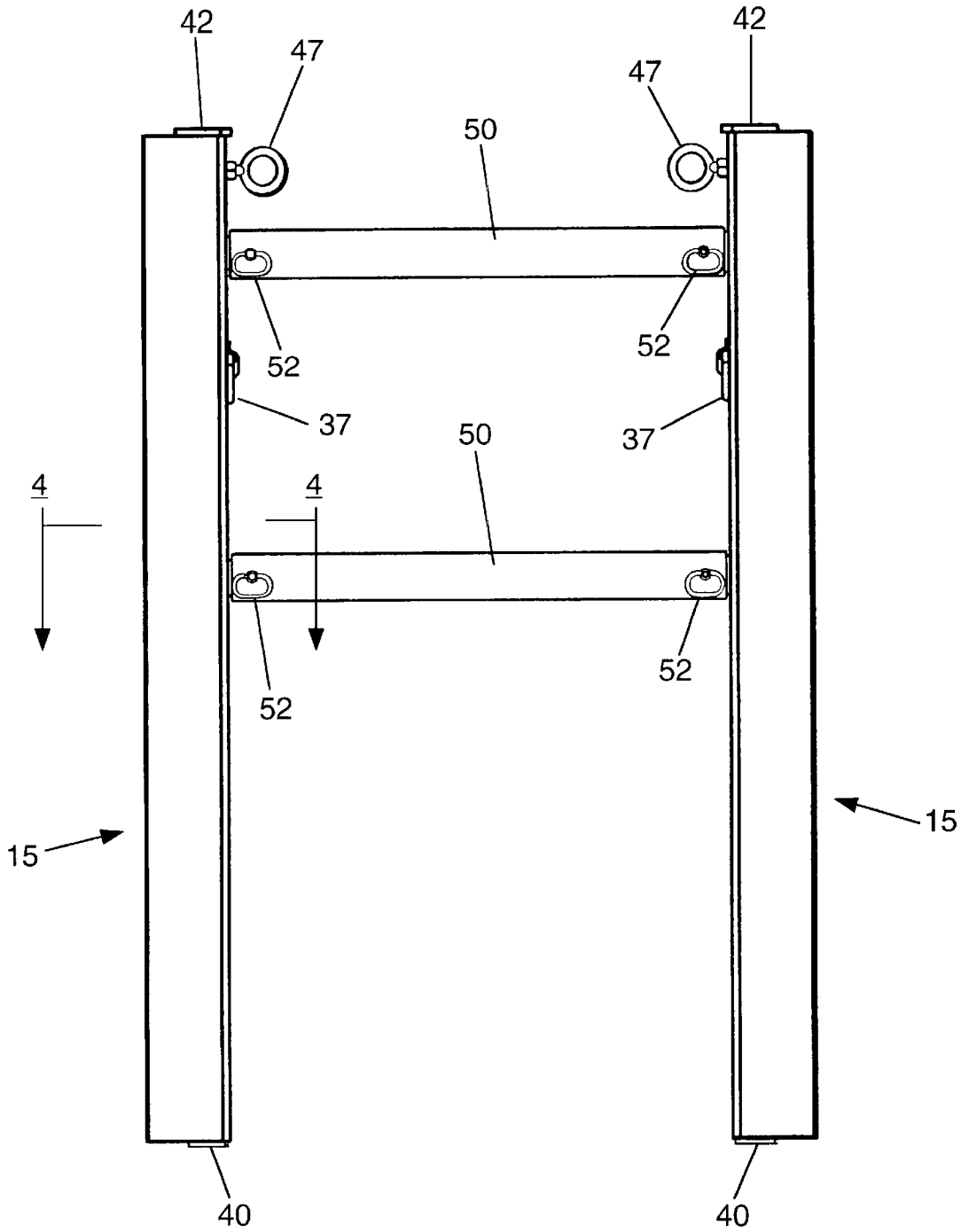
FIG. 3 is a side elevational view of the trench shield and shoring device seen in FIG. 1.
Figure 4:
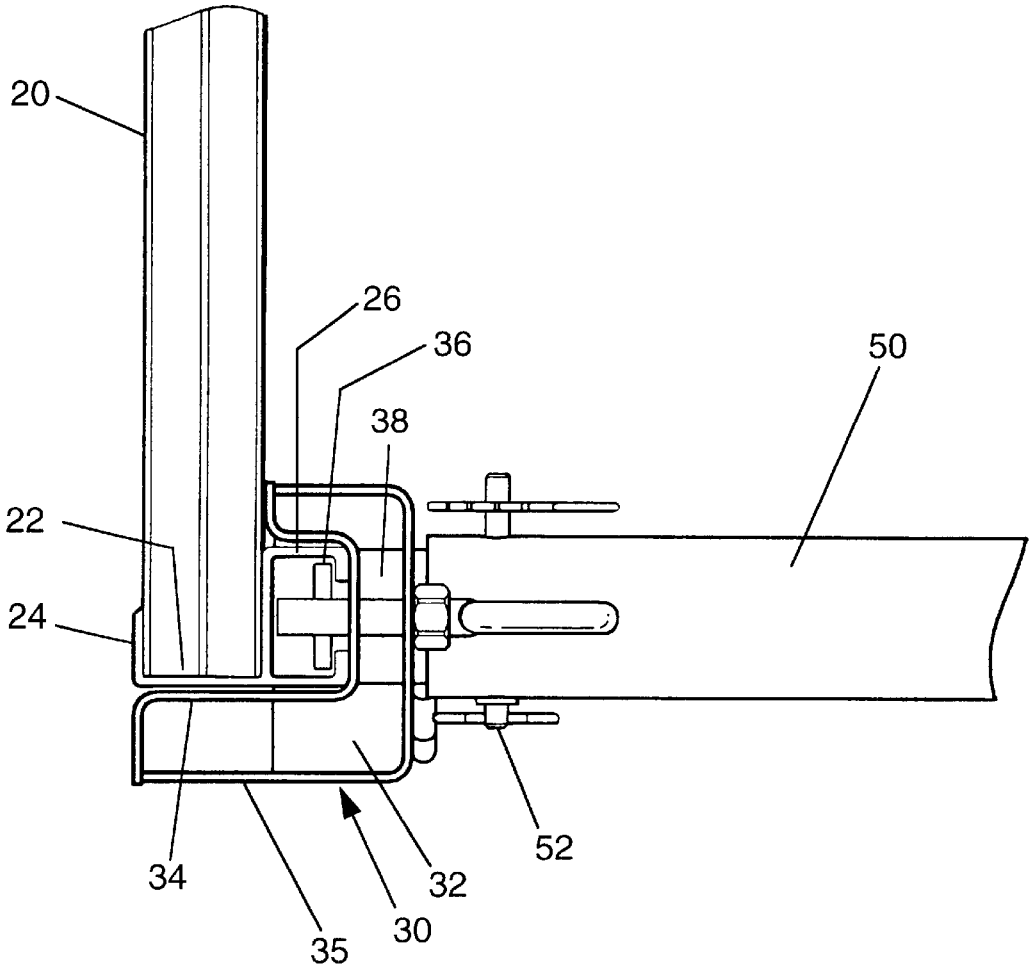
FIG. 4 is an enlarged partial cross-sectional view taken from 4—4 on FIG. 3.
Figure 6:
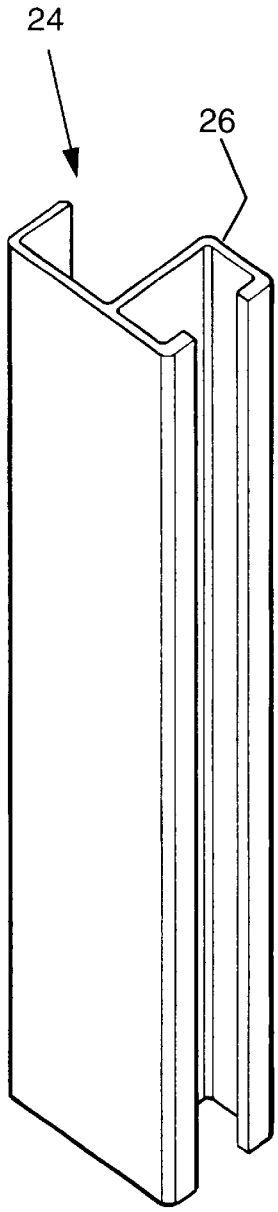
FIG. 6 is an enlarged and partially exploded view of the vertical support member of the trench shield and shoring device seen in FIGS. 2 and 4.

The present invention is directed to a portable shielding and shoring device 10 for securing sidewalls of an excavation. As shown in FIG. 1, an embodiment of the portable shoring device 10 includes a pair of opposing panel walls 15, preferably made of aluminum, mutually facing each other and held in spaced apart relationship by a support bar 50 As shown in FIG. 2, each wall 15 is assembled by using a single or stacked panels 20, with each panel having a vertical panel height 28. The vertical panel height 28 can be changed to meet the contractor's need, but preferably includes not less than three panel planks 20'. Attached to each panel end 22 are vertical support members 24 having a first engaging link, preferably a female connection bracket 26. The female connection bracket 26 is substantially C-shaped, as best seen in FIGS. 4 and 6.

Figure 5:
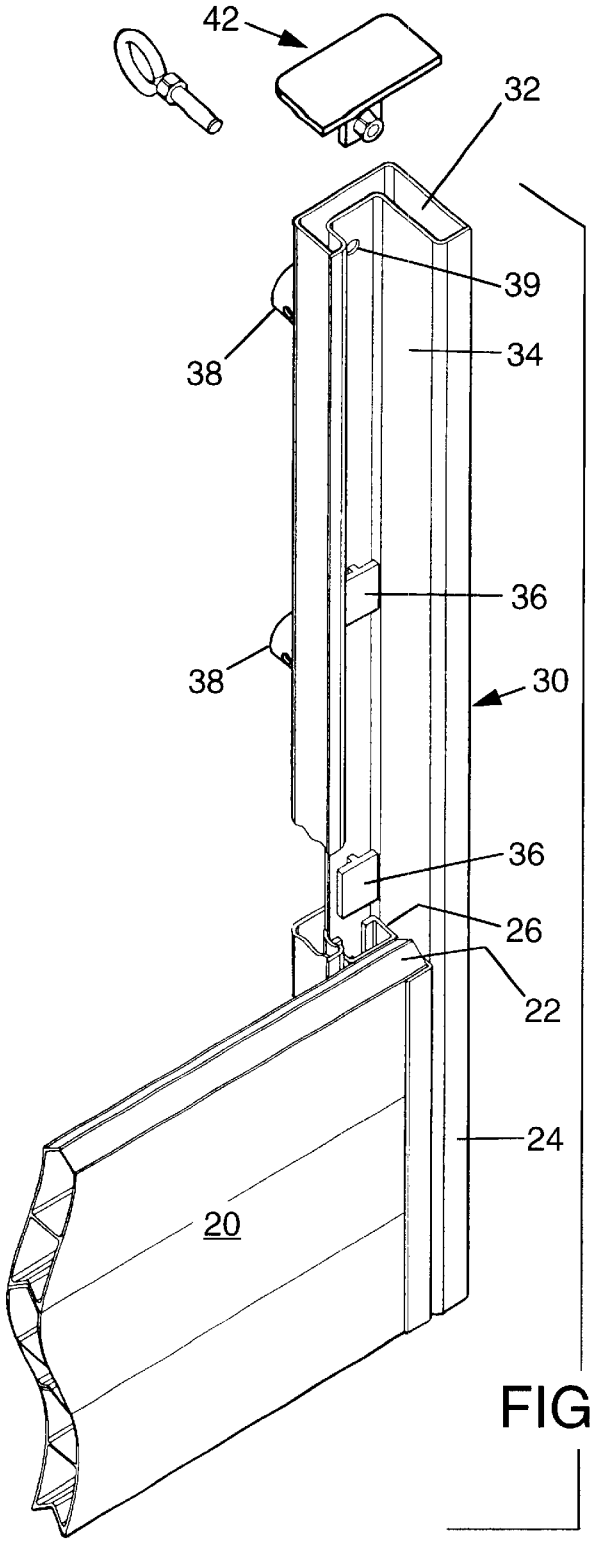
FIG. 5 is a partial view showing the panel connector and panel of the trench shield and shoring device seen in FIG. 1 invention.
Figures 7, 8:
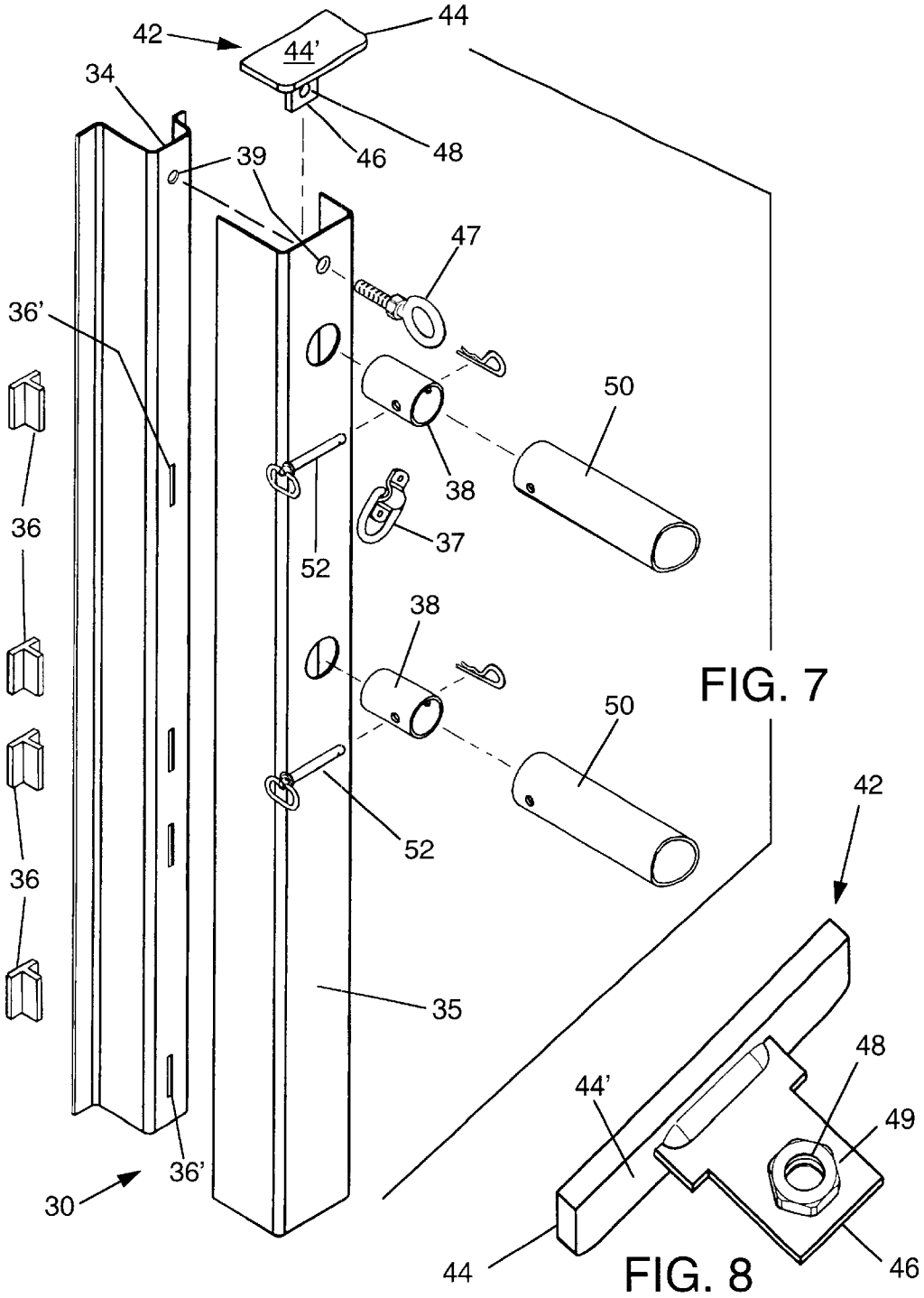
FIG. 7 is an exploded view of the panel connector assembly of the trench shield and shoring device seen in FIG. 1.
FIG. 8 is an enlarged view of the top panel lock of the trench shield and shoring device seen in FIGS. 1, 2 and 7.

Viewing FIGS. 2, 4, 5 and 7, a panel connector 30, constructed of either aluminum or steel, is shown. The panel connector 30 is substantially hook or J-shaped with one side being slightly longer than the other. The panel connector 30 is preferably made using two attached parts, an inside channel 34 and an outside face 35, to form a substantially hollow panel connector body 32. Attached to the inside channel 34 of the panel connector 30 is a second engaging link which is preferably a plurality of male extensions or connectors 36. The posterior ends of the male connectors 36 are fitted and secured through intermittently spaced rectangular openings 36' through the inside channel 34 of the panel connector 30. More specifically, for maximum structural support the posterior end of each male connector 36 fits into the corresponding rectangular opening 36' and is attached by weld to the backside of the inside channel 34. The male connector 36 can have various shapes. For example, the shape may be substantially T-shaped as shown in the drawings, or it may have a substantially round shape structure with a stem extending radially therefrom. Also, as an alternative the male connector 36 may have a mushroom shape. The preferred embodiment of the male connector 36, however, is T-shaped, as shown in FIGS. 5 and 7.

Support bar adaptors 38 are attached to the outside face 35 of the panel connector 30 for receiving the ends of the attached support bars 50. More specifically, the support bar adaptors 38 are substantially hollow cylinders or pipes which fit through circular openings 38' through the outside face 35 of the panel connector 30 and welded thereto. To attach the support bars during assembly, the ends of the support bar 50 are fitted over disposed support bar adaptors 38 of oppositely disposed panels 20 and securely attached thereto with support bar locking pins 52.

Top panel locks 42 are used to removably, yet rigidly, secure assembled vertical support members 24 to panel connectors 30 to prevent any movement of the panels 20 therein. The top panel lock 42 may simply be a clamping unit commonly used in the art. However, in the preferred embodiment, the top panel lock 42 fits into the C-shaped female connection bracket 26 at the top end of each vertical support member 24. More specifically, the top plate 42 is T-shaped having a planar top plate 44 attached to an extended insert 46, as shown in FIG. 8. The extended insert 46 is welded to the underside face 44' of the top plate 44 so that it is substantially centered on the face 44'. The extended insert 46 has an opening 48 for receiving a top panel lock bolt 47. The opening 48 is threaded or, as an alternative, a threaded nut 49 may be aligned around the opening 48 and welded thereto.

Cooperating with the top panel locks 42 are stop plates 40 attached by weld to the bottom end of each panel connector 30. The stop plate 40 covers the cross sectional opening of the panel connector body 32 and, like the top panel locks 42, is intend to prevent any movement of the assembled panels 20 secured by the corresponding panel connector and vertical support member. Also, the bottom stop plates 40 hold panels 20 in place while assembling the shielding and shoring device 10.

Finally, normally located below each support bar adaptor 38 on the outside face 35 of the panel connector 30 is a D-ring 37 which is used for lifting and moving the assembled shielding and shoring device 10 with a backhoe or other lifting apparatus. However, the position of the D-rings on the outside face 35 of the panel connectors 30 can be changed depending on specific needs or manufacturing specifications.

To assemble the shielding and shoring device 10, two panels 20 are laid down on a flat surface and arranged opposite each other in spaced apart relationship with the female connection brackets 26 of the vertical support members 24 facing upward. A panel connector 30 is then connected or linked at each end of the two oppositely arranged panels 20 through the vertical support members 24 by fitting and sliding the male connectors 36 of the panel connector 30 into the respective female connection bracket 26,of the vertical support members 24 until each panel engages the corresponding stop plate 40. Of course, as an alternative, the male connectors 36 may be attached to the vertical support members 24 and the female connection bracket 26 may be part of the panel connector 30. Ultimately, the important part of the design is the slideable linkage and connection therebetween.

The panels 20, with respective panel connectors 30 attached thereto, are then brought to a vertical standing position so that they face each other in a substantially perpendicular coupling relationship. Support bars 50 are then connected to the panel connectors 30 by attaching each end of the support bars 50 to corresponding support bar adaptors 38 aligned by the coupled panels. The hollowed ends of the support bars 50 are essentially fitted over the support bar adaptors 38 and securely connected thereto with support bar lock pins 2 Each locking pins 52 of course fit through an aligned opening located through the attached support bar 50 and support bar adaptor 38.

At this time, there should be a secure, albeit incomplete, standing shoring device 10. Workers then simply lift and slideably connect additional panels 20, as shown in FIG. 2, into the panel connectors 30 until the desired height of the shoring device 10 is reached. As best viewed in FIGS. 4 and 5, the connection formed between the male connector 36 of the panel connector 30 and the female connection bracket 26 of the vertical support member 24 is slideable, yet sturdy and secure.

Once the shoring device 10 is assembled, the top panel locks 42 are attached to the shoring device 10 by sliding the corresponding extended inserts 46 into the respective four top ends of the vertical female connection brackets 26 of the vertical support members 24. In place, the top plate 44 of the top panel lock 42 rests on the top of the female connection bracket 26. Top panel lock bolts 47 are used to securely hold the top panel locks 42 in place. Each bolt 47 fits through a top panel lock bolt opening 39 located on the outside face 35 of the panel connector 30 and then threadably engages the opening 48 of the extended insert 46 of the top panel lock 42. As previously stated, once the top panel locks 42 are secured in place, they secure the vertical support members 24 with the panel connectors 30 so that the panels 20 are held in place, as shown in FIG. 1, when using the shoring device 10 in an excavated trench.

The top plate 44 of the top panel lock 42 serves other functions as well. For example, it shields dirt or other debris from falling into the female connection bracket 26 or the inside channel 34 of the panel connector 30 while using the shoring device 10. This feature greatly reduces degradation of the materials used in the shoring device 10 by eliminating abrasive contact with dirt and debris, thereby maintaining its integrity after repeated use. Further, the shielding feature of the top plate 44 facilitates easy assembly and disassembly of the shoring device 10 because it eliminates the necessity to remove dirt and debris from the engaging channels of the female connection bracket 26 and the panel connector 30 during assembly and disassembly. Also, due to irregularities of a trench face, it may be necessary to use the boom of a backhoe to hammer the assembled shoring device 10 into the excavated trench until the desired depth is reached. The top plate 44, therefore, serves as an excellent surface for the boom of the backhoe to strike.

In conclusion of the description of assembly and use, after the shoring device 10 is fully assembled, it is moved to a desired location for placement in an excavated trench. First, chains are hooked through each of the D-rings 37 and attached to the boom of a backhoe. The chained shoring device 10 is then lifted and moved to the location of the excavated trench and placed therein. Once. in place, the chain are removed and the boom of the backhoe is used to pound the shoring device 10 to a specified depth in the trench, if necessary, using the top plates 44 of the top panel lock 42 as described above. Once the shoring device 10 is securely in place, workers may safely enter the excavated trench and work therein.

Having described presently preferred embodiments of the invention, it is to be understood that other versions are possible. Therefore, the spirit and scope of the appended claims should not be limited to the description of the preferred versions contained herein.

What is claimed is:

1. A portable shoring device for securing the sidewalls of an excavation, comprising:

a pair of panels, each having a generally planar exterior surface, an interior surface and two ends, the paired panels mutually facing each other and being held in spaced-apart relationship by at least one support bar, each panel having two vertical supports attached thereto, the vertical supports on each panel being at opposite ends and arranged to pair in a substantially perpendicular coupling relationship with the corresponding vertical supports of the paired panel, each vertical support traversing along the height of the panel and comprising a female connection bracket;

a plurality of panel connectors, each panel connector having an inside channel and outside face, a male connection means attaching to the inside channel of the panel connector, and a support bar adaptor attaching to the outside face of the panel connector;

each panel end being slideably connectable with at least one panel connector by interlocking the female connection bracket of the corresponding vertical support with the male connection means of the panel connector;

each panel connector having a bottom stop plate; and a top panel lock to vertically secure the vertical support within the panel connector.

2. The portable shoring device of claim 1, wherein each panel comprises at least three planks.

3. The portable shoring device of claim 2, wherein the top panel lock comprises a top plate and an extended insert.

4. The portable shoring device of claim 1, wherein the support bar adaptors of coupled panel connectors are aligned in a substantially perpendicular coupling relationship.

5. The portable shoring device of claim 1, wherein the male connection means is an engaging extension.

6. The portable shoring device of claim 5, wherein the male connection extension has a substantially round cross-sectional shape attached to a lateral extension extending substantially perpendicular from the inside channel of the panel connector.

7. The portable shoring device of claim 5, wherein the male connection extension has a substantially T-shaped cross-section extending substantially perpendicular from the inside channel of the panel connector.

8. The portable shoring device of claim 5, wherein the male connection extension has a substantially mushroom-shaped cross-section extending substantially perpendicular from the inside channel of the panel connector.

9. A device for securing sidewalls of an excavation, comprising:

a first and second panel, each panel having an exterior surface and an interior surface and a pair of distal ends, each panel having a vertical support attached on the interior surface at one of the distal ends, the vertical support of the first panel being arranged to pair in substantially perpendicular coupling relationship with the vertical support of the second panel, each vertical support having a female connection bracket;

at least two panel connectors, each panel connector having an inside channel and an outside face, a male connection extension attached to the inside channel of each panel connector, and a support bar adaptor attached to the outside face of the panel connector;

each panel connector being slidably connectable with one of the vertical supports by slidably interlocking the corresponding male connection extension with the female connection bracket of the corresponding vertical support;

each panel connector having a bottom stop plate; and a top panel lock to vertically secure the interlocked panel connector and vertical support.

10. The device of claim 9, wherein the support bar adaptor of the interlocked panel connector of the first panel is perpendicularly aligned with the support bar adaptor of the interlocked panel connector of the second panel.

11. The device of claim 9, wherein the male connection extension has a substantially T-shaped cross-section extending perpendicular from the inside channel of the panel connector.

12. A portable shoring device for securing the sidewalls of an excavation, comprising:

a pair of panels, each having a generally planar exterior surface, an interior surface and two ends, the paired panels mutually facing each other and being held in spaced-apart relationship by at least one support bar, each panel having two vertical supports attached thereto, the vertical supports on each panel being at opposite ends and arranged to pair in a substantially perpendicular coupling relationship with the corresponding vertical supports of the paired panel, each vertical support traversing along the height of the panel and comprising a first engaging link;

a plurality of panel connectors, each panel connector having an inside channel, an outside face and a bottom stop plate, a second engaging link attaching to the inside channel of the panel connector, and a support bar adaptor attaching to the outside face of the panel connector, each panel end being removably attached with at least one panel connector by slideably interlocking the first engaging link of the corresponding vertical support with the second engaging link of the panel connector; and a top panel lock to vertically secure the vertical support within the panel connector.

13. The portable shoring device of claim 12, wherein the first engaging link of the vertical support is a female connection bracket and the second engaging link of the panel connector has an interlocking male connection extension.

14. The portable shoring device of claim 12, wherein the first engaging link of the vertical support is a male connection extension and the second engaging link of the panel connector has an interlocking female connection bracket.

15. The portable shoring device of claim 12, wherein the support bar adaptors of coupled panel connectors are perpendicularly aligned.

16. A method for assembling a portable shoring device, comprising the steps of:

arranging two panels on a surface being opposite each other in spaced apart relationship, each panel having a vertical support member at an end and the vertical support member having a panel connection bracket, the panel connection bracket facing upward;

slideably engaging each panel connection bracket with a panel connector until the respective panel engages a stop plate attached to said panel connector, each panel connector having a support bar adaptor attached thereto;

raising each panel to a vertical standing position and connecting the panels with a support bar by engaging the support bar adaptors so that the panels are vertically opposed in a substantially perpendicular coupling relationship;

lifting and slideably connecting additional panels until the desired height of the shoring device is reached; and attaching a top panel lock to a top end of each connection brackets so that the panels are held in place when the portable shoring device is in use.

17. The method of claim 16, wherein the panel connection bracket of the vertical support is a female connection bracket and the panel connector has an interlocking male connection extension.

18. The method of claim 16, further comprising the step of hammering a top plate of the top panel lock until the portable shoring device reaches a desired depth in an excavated trench.

* * * * *